United States Patent [19]

Tuovinen et al.

[11] Patent Number: 4,464,764

[45] Date of Patent: Aug. 7, 1984

[54] DEVICE FOR MOVING SOLID MATERIAL FED ONTO THE SURFACE OF A MELT AND FOR BREAKING A SLAG CRUST FORMED ON THE SURFACE OF THE MELT OR INSIDE THE CHARGE

[75] Inventors: Norrman, Helsinki, both of Finland; Risto M. Heikkilä, Haparanda, Sweden; Matti E. Honkaniemi, Tornio, Finland

[73] Assignee: Outokumpu Oy, Helsinki, Finland

[21] Appl. No.: 341,458

[22] Filed: Jan. 21, 1982

[51] Int. Cl.[3] ..... F27D 23/02

[52] U.S. Cl. ..... 373/87

[58] Field of Search ..... 373/86, 87

[56] References Cited

U.S. PATENT DOCUMENTS

| | | | |
|---|---|---|---|
| 1,778,809 | 10/1930 | Miguet | 373/86 |
| 3,909,499 | 9/1975 | Stark | 373/87 |
| 3,975,576 | 8/1976 | Krogsrud | 373/86 |

*Primary Examiner*—Roy N. Envall, Jr.

*Attorney, Agent, or Firm*—Dressler, Goldsmith, Shore Sutker & Milnamow, Ltd.

[57] ABSTRACT

The invention relates to a device for poking a charge fed onto the surface of a melt in an electric arc furnace having a hood and an external cooled casing (2) articulated at one of its ends to the lower section (21) of a horizontal circumferention bend in the wall of the furnace (23) hood (24) which faces the melt, drive cylinders (5) for tilting the casing in different directions about its joint, a spindle ( 1) installed tightly in the cooled casing (2) and being axially reciprocating and rotatable, and drive cylinders (17) for making the spindle (1) to project from said one end of the casing (2) to poke the charge fed onto the melt surface and break any crust on the melt surface or inside the solid charge, when the cooled casing (2) and the spindle (1) inside it are tilted about the joint and rotated.

6 Claims, 5 Drawing Figures

Figure 2:
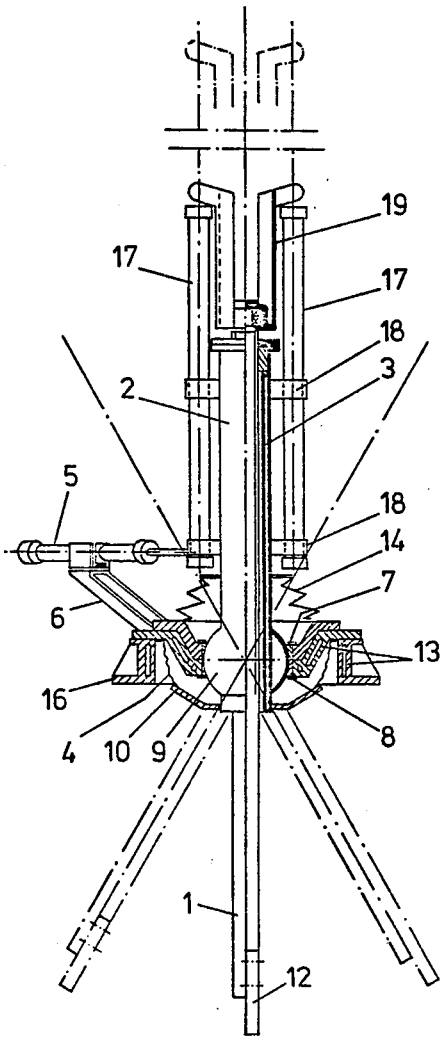

DEVICE FOR MOVING SOLID MATERIAL FED ONTO THE SURFACE OF A MELT AND FOR BREAKING A SLAG CRUST FORMED ON THE SURFACE OF THE MELT OR INSIDE THE CHARGE

The present invention relates to a device for moving solid material fed onto the surface of a melt and for breaking a crust formed on the melt surface or inside the charge, and especially to a device intended to be installed in the vault or hood of a closed or semi-closed electric arc furnace.

Previously known are various mechanical devices provided with a pole, by means of which the material fed into the furnace is pounded (i.e. pushed into those areas in which melting is most rapid) and by means of which a crust formed on the surface of the melt or inside the solid charge is broken. It is known to mount such a device on rails encircling the furnace, in which case there are, located circumferentially on the furnace, inlets which can be opened and through which a pole can be pushed into the furnace for the above-mentioned purposes. This device has a disadvantage in that excess air passes uncontrolled into the furnace, thereby causing losses of reductant, imprecision in the process, and expensive investment in oversized gas purification and gas treatment systems.

The essential point is that it is difficult to force a tool through a loose, crushed stone like bed into the crust or slag formed by sintering inside a solid charge consisting of particles of different size (0.200 mm), so that the tool would locally break the said crust or slag. The existing devices press the entire charge, whereby the entire furnace charge collapses into the melt at the same time, thereby causing explosions, as well as blasts of gas, melt and solid around the furnace hall, often also damaging the electrodes. The object of the present invention is to eliminate the above-mentioned disadvantages by providing a device which penetrates the loose bed, breaking the crust or slag locally. The penetration is achieved by a continuous combination of three movements, i.e. an axial push or impact, a continuous or reciprocal rotation of the tool, and lateral movements, i.e. pounding, of the tool in different directions. The above-mentioned movements enable the tool to penetrate the loose bed past even the large charge particles.

The device according to the invention can be used in very different furnaces, but it is especially advantageous to install it in that wall section of a closed electric arc furnace vault or hood which faces the melt.

The device according to the invention consists of a cooled casing which has been articulated at approximately one of its ends to the vault or hood of the furnace and which can be tilted in different directions about its joint by means of drive cylinders mounted between the casing and the outer wall of the hood or vault. Extending tightly through the cooled casing there is a spindle which can be axially reciprocated and, when necessary, rotated about its axis. By means of a drive cylinder fitted between the spindle and the cooled casing the spindle can be caused to project from the articulated end of the cooled casing to move the solid material fed onto the melt surface and/or to break the crust on the surface of or inside the melt, when the cooled casing and the spindle in it are tilted about the joint. The rotational motion of the spindle can be arranged either by means of a rotating mechanism or by means of an axially fitted, gently sloping thread or screw which is rotated reciprocatingly by means of a pneumatic or hydraulic cylinder or a screw.

If the cooled casing is tilted by using one, two or several drive sylinders which are at an angle to each other, the device according to the invention can be tilted arbitrarily in any direction, especially when the joint at the end of the cooled casing is a ball joint. The device according to the invention is advantageously mounted on a separate ring, tightly encircling the hood or vault of the furnace, the ring being rotatable about the vertical axis of the furnace in order to move the device according to the invention on the circumference of the vault or hood. It is evident that there may be several devices according to the invention mounted circumferentially on the hood or vault at regular intervals from each other, but by using the above-mentioned rotating ring and the device according to the invention mounted on such ring, one single device according to the invention can be used to pound and even out the material fed into the furnace, and to break the melt surface within the entire area required.

The device according to the invention is advantageously installed in the lower section of the wall, facing the melt, of the bend encircling the hood in a horizontal plane. This facilitates the directioning of the spindle extending through the cooled casing of the device towards the melt surface. The hottest point in the furnace is above the wall of the bend in the hood, and in this case the device according to the invention remains in the lower section of the hood, where no actual burning of the gases occurs. The device according to the invention can also be protected from radiation by means of a radiation shield fitted in front of the joint at that end of the cooled casing which faces the furnace.

Figure 1:
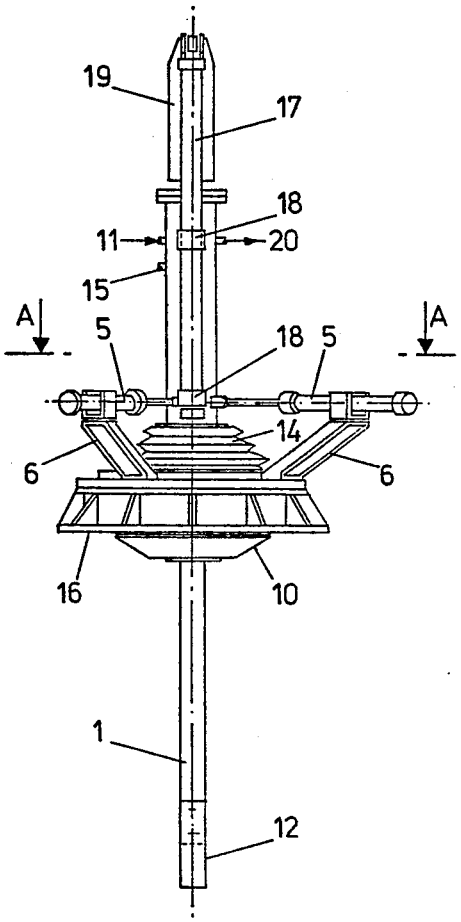
Figure 4:
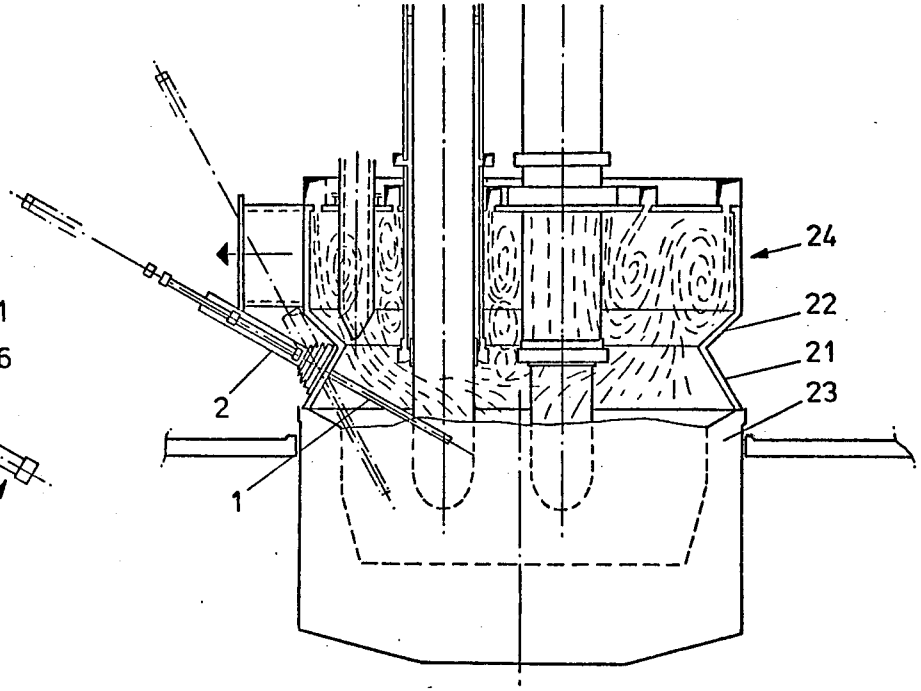
Figure 3:
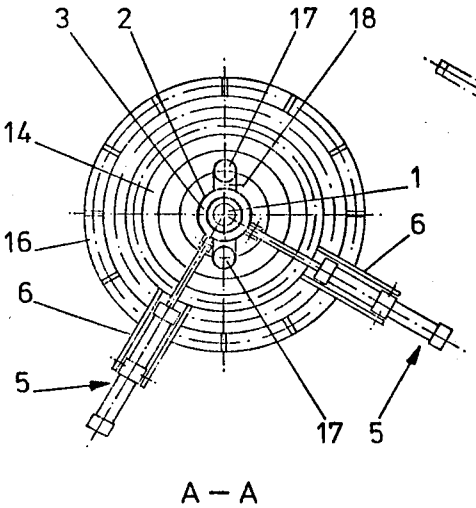
Figure 5:
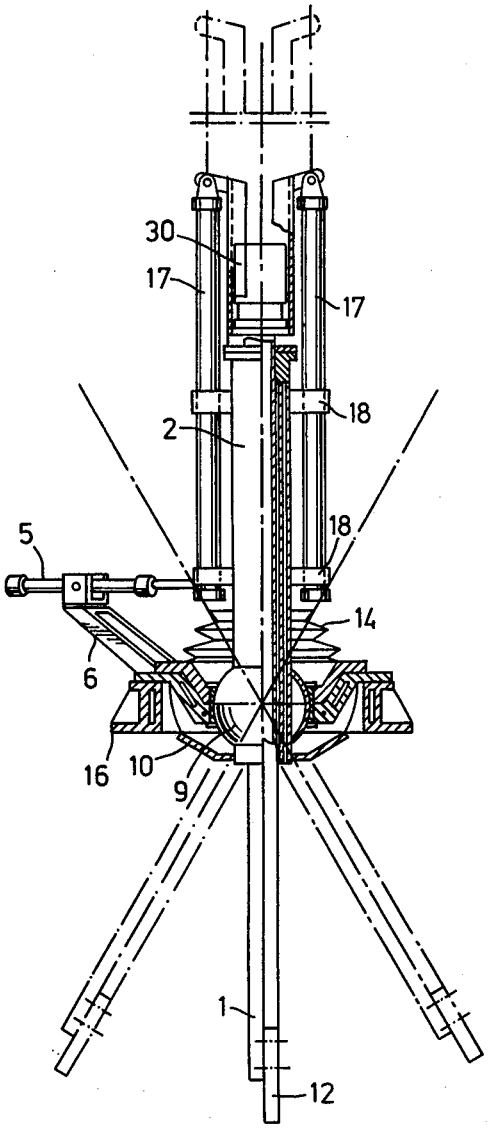

The invention is described below in greater detail with reference to the accompanying drawings, in which FIG. 1 depicts a side view of the device according to the invention, FIG. 2 depicts a vertical section of the same device, FIG. 3 depicts a section along line A—A in FIG. 1, and FIG. 4 depicts a device according to the invention, installed in an electric arc furnace, and FIG. 5 is a view similar to FIG. 2 in which a conventional mechanism for rotating the spindle has been illustrated.

In FIGS. 1–3, that part by means of which the device according to the invention is attached to the hood or vault is indicated by reference numeral 16. This attachment part 16 has cooling-water channels 13, by means of which the attachment parts of the device according to the invention are cooled. The oblong cylindrical casing provided with a cooling-water channel 3 is indicated by 2, and the ball joint at one of its ends by reference numeral 9. The ball joint 9 engages in the attachment part 16 over the upper bearing section 7 and over the lower bearing section 8 so that the cooled casing 2 can be turned freely in every direction about its joint 9. At that end of the cooled casing which faces the furnace there is also attached a radiation shield 10 in front of the ball joint 9 in order to shield the latter from radiation form the furnace. In addition, the radiation shield 10 is connected to the attachment part 16 by bellows 4 in order to prevent furnace gases from escaping to outside the furnace through the joint 9. On the opposite side of the attachment part 16 there is a second bellows 14, which is attached to the cooled casing 2 and to the attachment part 16.

The spindle, or pick rod, fitted inside the cooled casing 2 and movable axially reciprocatingly in it, is indicated by 1. At that end of the spindle which is towards the furnace there is a preferably replaceable tool 12 for different uses, e.g. a spade, a scoop or a pounder for pounding and evening out the material fed into the furnace or a pick for piercing and breaking the crust formed on the surface of inside the furnace. Furthermore, in the cooled casing 2 there is fitted an inlet channel 15 for directing shield gas between the cooled casing 2 and the spindle 1 in order to prevent furnace gases from escaping to outside the furnace from between the spindle 1 and the cooled casing 2.

In addition, the cooled casing has an inlet pipe 11 for feeding cooling water into the cooling-water channels 3 of the cooled casing 2 and an outlet pipe 20 for removing cooling water from the cooling-water channel 3.

Furthermore, on the opposite side of the cooled casing 2 there are attachment members 18 for attaching two drive cylinders 17 in parallel on the opposite sides of the cooled casing. The piston rods of these drive cylinders 17 are attached to connecting pieces 19, which for their part are attached to that end of the spindle 1 which extends to beyond that end of the cooled casing 2 which is opposite the ball joint 9. By means of the drive cylinders 17 that end of the spindle 1 which is towards the furnace can be pulled inside the cooled casing 2 in order to keep the spindle 1 cooled when it is not in use. At their other extreme position the drive cylinders 17 push the spindle 1 out of the cooling casing 2 so far into the furnace that the tool 12 at the end of the spindle 1 extends as far as the melt.

In order to tilt the cooling casing 2 and the spindle 1 in it about the ball joint 9, there are attached to the cooling casing 2 two drive cylinders 5 which are at an angle to each other on a plane parallel to the attachment part 16, the cylinders 5 being mounted on the attachment part 16 by means of attachment members 6. By means of the working cylinders 5 the spindle 1 can be turned arbitrarily in any direction, so that the tool 12 at the end of the spindle 1 follows a straight, curving or even circular track.

FIG. 4 shows the installation of a device according to FIGS. 1–3 in the hood 24 of an electric arc furnace 23. The hood 24 has a bend all the way around, and the upper section 22 of the wall of the bend, facing away from the melt, directs the gases which flow downwards along the walls in the upper section of the hood 24 away from the spindle 1. The lower section 21 of the wall of the bend, facing the melt, also facilitates the directioning of the spindle 1 towards the melt.

In the hood depicted in FIG. 4, the bend 21, 22 in its entirety, or at least the lower section 21 of its wall, which faces the melt and to which the device according to the invention is fitted, can be a separate ring, tightly fitted to the hood, which is rotatable about the vertical axis of the furnace in order to move the device according to the invention along the circumference of the hood 24. In this case, only one device according to the invention is required for each hood 24, since the device can be moved to any necessary point along the circumference of the hood 24.

FIG. 5 is a view similar to FIG. 2 in which a conventional means for rotating the spindle, such as, the hydraulic motor 30, is provided.

We claim:

1. A device for moving solid material fed onto the surface of a melt and/or for breaking a crust formed in or on the surface of the melt in a furnace comprising a casing supporting a spindle and defining a cooling chamber surrounding said spindle, means for rotatably supporting said casing relative to the furnace, means for rotating said spindle and for tilting said casing relative to said furnace, and means for reciprocating said spindle relative to said casing to stir or break up the material fed into the melt and cool the spindle when it is not in use.

2. A device according to claim 1 in which the means for rotating said spindle and tilting said casing relative to said furnace comprises a plurality of cylinders installed between said furnace and said casing, which cylinders are disposed transverse to said casing.

3. A device according to claims 1 or 2 in which the means for moving the spindle comprises a pair of drive cylinders located on opposite sides of the casing and secured to the end of the spindle projecting from the end of the casing distal from the furnace.

4. A device according to claim 1 in which the means for rotatably supporting the casing comprises a ball joint which allows the casing and spindle to be tilted freely in any direction.

5. A device according to claim 4 including a radiation shield disposed between the ball joint and the interior of said furnace.

6. A device according to claim 2 in which the portion of the furnace to which the casing is connected comprises a ring that it tightly fitted, but rotatably mounted relative to said furnace, whereby the casing can rotated about the vertical axis of the furnace in order to move the casing relative to the furnace to permit the casing to be moved to various positions relative to the furnace.

* * * * *

UNITED STATES PATENT AND TRADEMARK OFFICE

CERTIFICATE OF CORRECTION

PATENT NO. : 4,464,764

DATED : August 7, 1984

INVENTOR(S) : Frans H. Tuovinen, Bengt F. Norrman, Risto M. Heikkilä, Matti E. Honkaniemi It is certified that error appears in the above-identified patent and that said Letters Patent is hereby corrected as shown below: On the title page Inventors are: Frans H. Tuovinen, Ulvila,
Bengt F. Norrman, Helsinki, both of Finland,
Risto M. Heikkilä, Haparanda, Sweden,
Matti E. Honkaniemi, Tornio, Finland Add:
Foreign Application Priority Data:

June 19, 1980 [FI] Finland 80.1082
PCT/FI 81/00042, filed June 5, 1981

Signed and Sealed this

*Seventeenth* Day of *December 1985*

[SEAL]

*Attest:*

*Attesting Officer*

DONALD J. QUIGG

*Commissioner of Patents and Trademarks*